US005161279A

United States Patent [19]

Sager et al.

[11] Patent Number: 5,161,279

[45] Date of Patent: Nov. 10, 1992

[54] TRUCK/CAMPER WINDOW CLEANING DEVICE

[76] Inventors: Larry C. Sager, 3850 Imperial Way #1, Carson City, Nev. 89706; James Hibbs, P.O. Box 13435, Spokane, Wash. 99213

[21] Appl. No.: 730,064

[22] Filed: Jul. 15, 1991

[51] Int. Cl.[5] ..... A47L 1/06

[52] U.S. Cl. ..... 15/220.1; 15/210.1; 15/118; 15/121; 15/247; 15/244.1; 15/245

[58] Field of Search ..... 15/210 R, 118, 121, 15/114, 117, 220 R, 144 R, 146, 147 R, 147 A, 170.6, 244.1, 245, 247

[56] References Cited

U.S. PATENT DOCUMENTS

| | | | |
|---|---|---|---|
| 2,537,482 | 1/1951 | Reilly | 15/220 R |
| 2,678,458 | 5/1954 | Vosbikian | 15/117 |
| 2,893,029 | 7/1959 | Vosbikian | 15/244.1 |
| 3,220,040 | 11/1965 | Knaebe | 15/147 R |
| 3,340,556 | 9/1967 | Allen | 15/144 R |
| 3,526,918 | 9/1970 | Leland | 15/244.1 |

FOREIGN PATENT DOCUMENTS

| | | | |
|---|---|---|---|
| 2848958 | 5/1980 | Fed. Rep. of Germany | 15/220 R |

*Primary Examiner*—Harvey C. Hornsby
*Assistant Examiner*—Tony G. Soohoo
*Attorney, Agent, or Firm*—Norman B. Rainer

[57] ABSTRACT

A window cleaning device adapted to clean facing surfaces of closely spaced parallel windows is made of an elongated head member having scrubber material associated therewith, and a rigid elongated straight handle which joins the head member in T-configuration. The head member has a central portion terminating in flexing regions, and rigid outer portions emergent from the flexing regions. When the head member is inserted between the windows, and the handle is twisted about its axis, the rigid outer portions are deflected in opposite directions away from the handle and thereby contact both facing window surfaces.

6 Claims, 2 Drawing Sheets

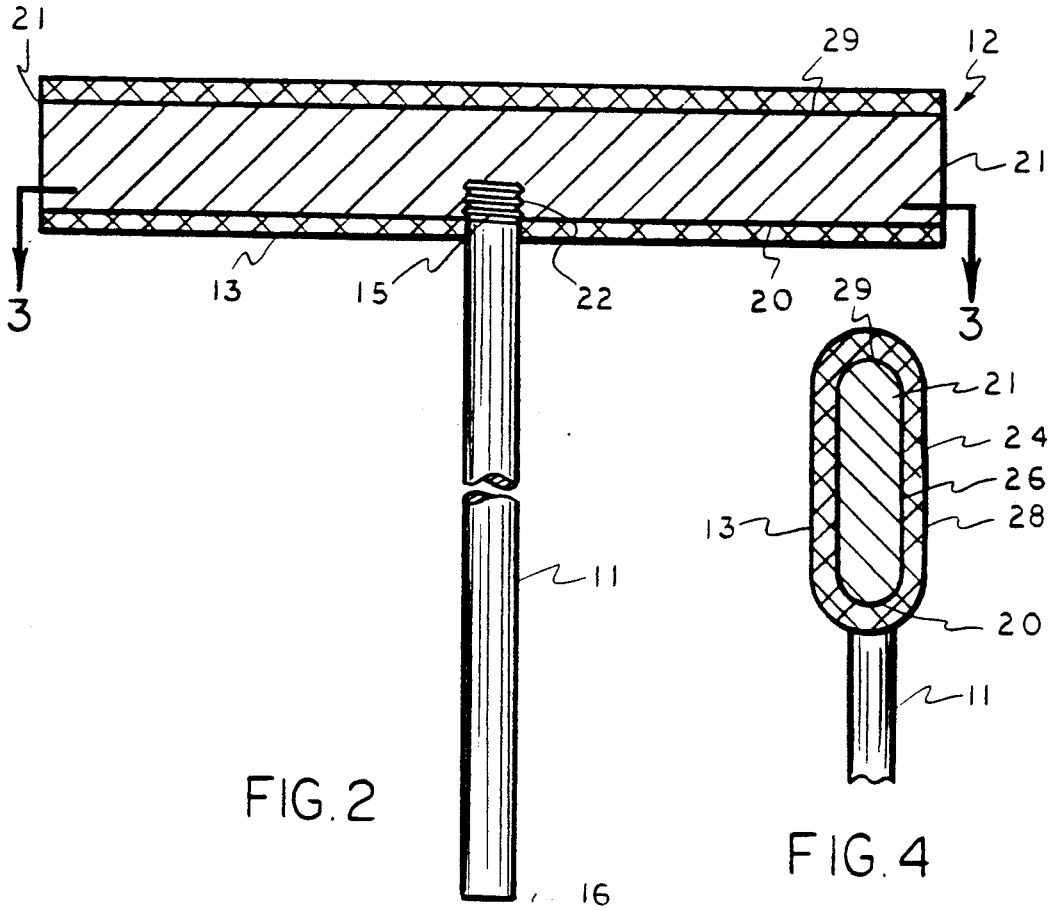
FIG. 2
FIG. 4
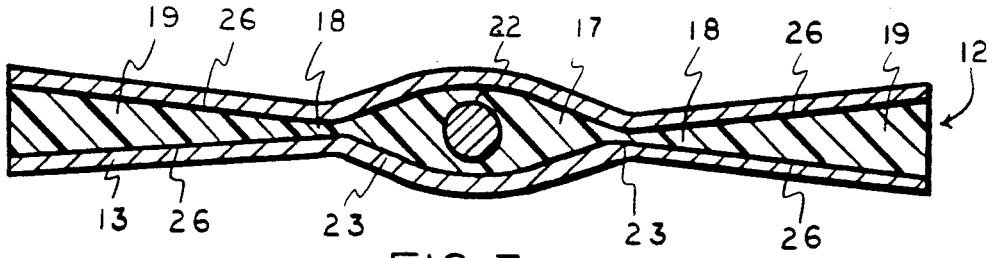
FIG. 3
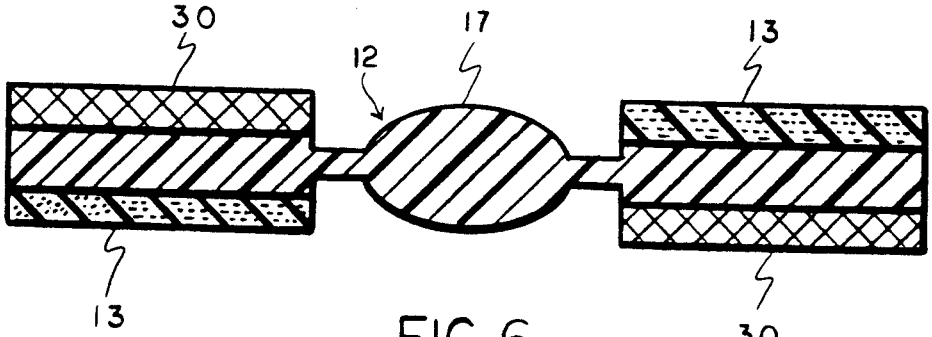
FIG. 6

TRUCK/CAMPER WINDOW CLEANING DEVICE

BACKGROUND OF THE INVENTION

1. Field of the Invention

This invention relates to a window cleaning device, and more particularly concerns a device for simultaneously cleaning the facing windows of a pick-up truck and associated camper shell.

2. Description of the Prior Art

Combination spong-squeegee devices are well known and have been proven to be most useful in washing windows in cars, homes, campers, and the like. The sponge is designed to carry liquid such as soapy water, and generally presents a rough or abrasive surface to assist in the cleaning process. A flexible, elastomeric blade is often associated with the sponge to provide a squeegee for removing the dirty, soapy water from the window. The sponge and squeegee usually are held by one extremity of an elongated rigid manipulating handle.

For example, U.S. Pat. No. 4,107,812 to Lantto discloses a cleaning device wherein a flexible blade and sponge are attached to an elongated holder by way of T-shaped protrusions and recesses. U.S. Pat. No. 3,837,747 to Seymore discloses a washer-squeegee in which separate squeegee and sponge members are attached to a holder by way of protrusions and recesses. U.S. Pat. No. 3,656,202 Paton discloses a sponge/-squeegee combination in which the squeegee is sandwiched between sponges and projects therefrom sufficiently for enabling removal of the dirty water. U.S. Pat. No. 3,526,918 to Leland discloses a device wherein the squeegee blade is attached to one side of the sponge and a wire handle extends through the central plane of the sponge. U.S. Pat. No. 2,886,839 to Leopoldi discloses a resilient water bottle having oppositively disposed squeegee and sponge members. U.S. Pat. No. 3,968,535 to Nichols discloses a cleaning device mounted upon an elongated handle and having cleaning elements including a sponge and window squeegee.

The above and related similar devices, designed primarily for the cleaning of glass windows, generally consist of a head unit mounted upon an elongated handle. However, such prior head units are usually too wide to be inserted into the gap between the parallel and closely adjacent facing windows of a pick-up truck and a camper shell mounted thereupon. Often this space is limited to less than two inches. The cleaning of the windows between a truck and camper shell requires an extremely long handle because the user's hand and arm will not fit within the narrow gap. Due to the long distance between the user's hand and the head of the cleaning device, and the obtuse angle between the glass and handle, it is difficult to bear enough pressure on the glass to scrub free stubborn dirt and grime. Moreover, most pick-up trucks have a high ground clearance which compounds the need for additional reach and pressure.

It is therefore an object of the present invention to provide a window cleaning device adapted to clean the facing glass surfaces of a pick-up truck and adjacent camper shell.

It is another object of the present invention to provide a device of the aforesaid nature with which sufficient pressure may be exerted upon said facing glass surfaces to dislodge dirt.

It is yet another object of the present invention to provide a device of the aforesaid nature which is of durable construction and amenable to low cost manufacture.

These objects and other objects and advantages of the invention will be apparent from the following description.

SUMMARY OF THE INVENTION

The above and other beneficial objects and advantages are accomplished in accordance with the present invention by a window cleaning device adapted to clean the facing glass window surfaces of the rear window of a pick-up truck and the front window of a closely adjacent camper shell, said device comprised of:

a) a rigid elongated straight handle, b) an elongated head member of monolithic construction having a rigid central portion orthogonally joined in T-configuration to said handle, said central portion terminating in flexing regions equidistantly spaced from opposite sides of said handle, and rigid outer portions emergent from said flexing regions in linear alignment with said central portion in a manner permitting resilient movement of said outer portions in a path perpendicular to said handle, and c) resilient porous scrubber material associated with said outer portions, whereby, d) when said device is held by said handle disposing said head member between said windows, and the handle is twisted about its axis, said outer portions are displaced away from the handle in parallel relationship and adapted to press said scrubber material against both said windows.

In a preferred embodiment, the scrubber material is adapted to be removably emplaced upon the rigid outer portions of the head member. The central portion of the head member may also carry scrubber material. Squeegee means may be associated with the device at either extremity of the handle. The head member and handle may be a single monolithic unit fabricated of thermoplastic by an injection molding operation.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing:

FIG. 2 is a vertical sectional view of the embodiment of FIG. 1 in its unflexed state.

FIG. 3 is a lateral sectional view taken upon the line 3—3 of FIG. 2.

FIG. 4 is a fragmentary end view.

FIG. 6 is a top view of an alternative embodiment of the window cleaning device of this invention.

DESCRIPTION OF THE PREFERRED EMBODIMENT

Figure 1:
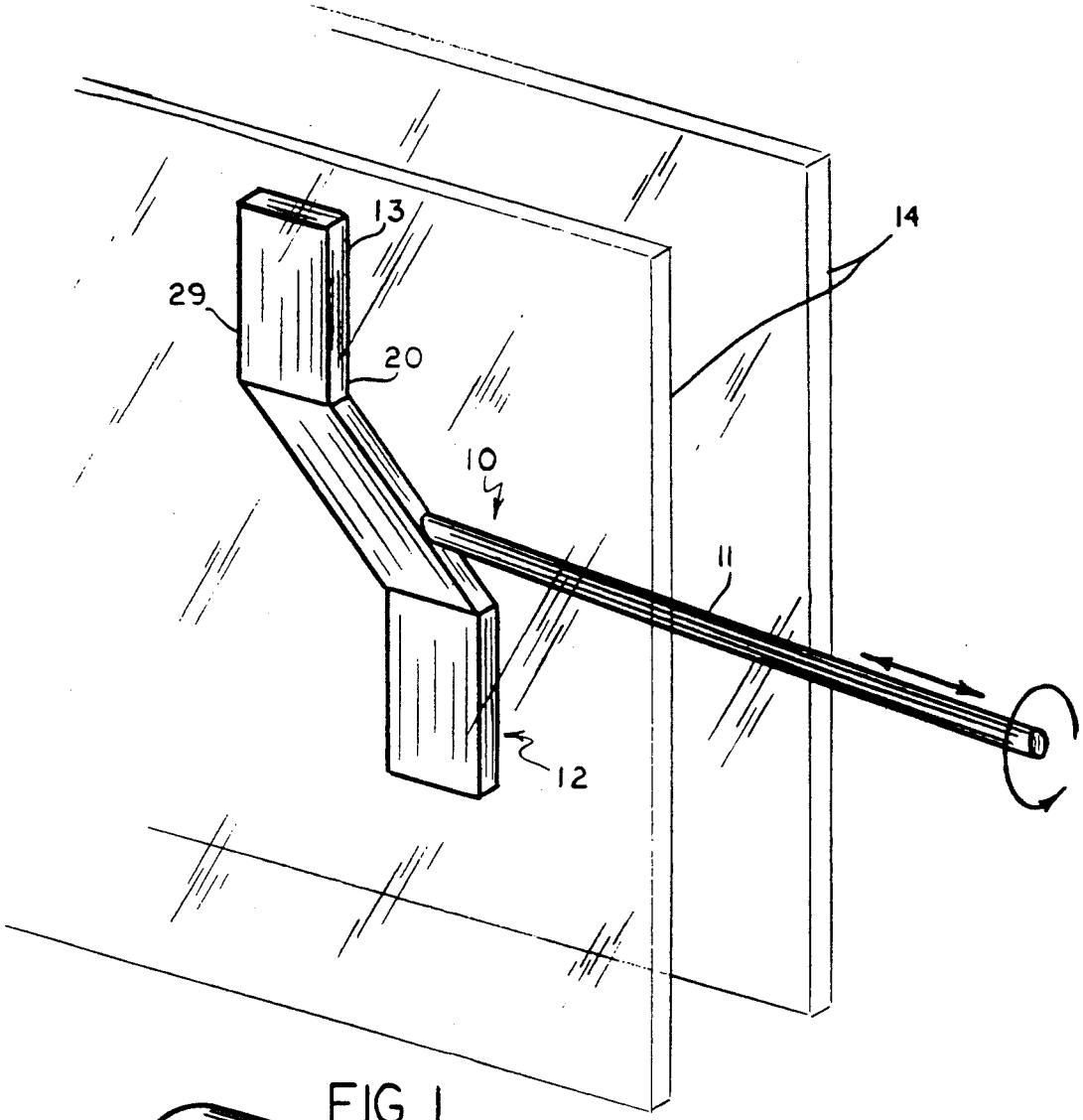
FIG. 1 is a perspective view of an embodiment of the window cleaning device of the present invention shown in flexed engagement with two closely adjacent windows.

Referring to FIG. 1, an embodiment of the window cleaning device 10 of the present invention, comprised of handle post 11, head member 12 and scrubber material 13 is shown disposed between closely adjacent window panels 14. The device is shown in a flexed state wherein twisting force imparted about the axis of the handle post causes the scrubber material to contact both window panels.

As further shown in FIG. 2, handle post 11 of the embodiment of FIG. 1 is of straight elongated configuration, having a uniform circular cylindrical slope. Said handle post is of rigid construction and may be fabricated of wood, metal or plastic. The illustrated handle post has a threaded proximal extremity 15 that engages head member 12. It is to be noted that the handle post attaches perpendicularly to the mid-point of head member 12, forming a T-shaped appearance. In those embodiments where the handle post is fabricated of plastic, the handle post may be integral with the head member as a result of manufacture by a molding process. The distal extremity 16 of the handle post may be equipped with a squeegee blade mounted in T configuration. In those embodiments wherein proximal extremity 15 is threaded, a separate squeegee member may be provided which can be attached to the handle post alternatively with head member 12. Quick release couplings such as bayonet fittings, Velcro hook and loop fastener material or other means may be employed alternatively to the illustrated threaded coupling.

As best shown in FIG. 3, head member 12 is of monolithic construction, having a rigid central portion 17 terminating in flexing regions 18, and rigid outer portions 19 emergent from said flexing regions in linear alignment with said central portion. The head member is preferably fabricated of a plastic such as polyethylene, polypropylene or ABS resin, said plastics being resilient in thin sections but rigid in thick structures. Accordingly, flexing regions 18 achieve their resiliency by virtue of the fact that they are of thinner cross-section than the associated central portion and outer portions.

The illustrated embodiment of the head member has a substantially rectangular side profile defined by upper and lower long edges 29 and 20, respectively, and short side edges 21. Although other configurations of the head member may be employed, the cross-sectional configurations of the outer portions are preferably reasonably uniform between edges 21 and corresponding flexing region 18. Said outer portions preferably have opposed flat faces 26 in general alignment with said handle post.

Central portion 17 is of thick enough cross section to accommodate threaded socket 22 adapted to secure the handle post. The outer extremities 23 of said central portion are shown to taper toward and merge with flexing regions 18.

Figure 5:
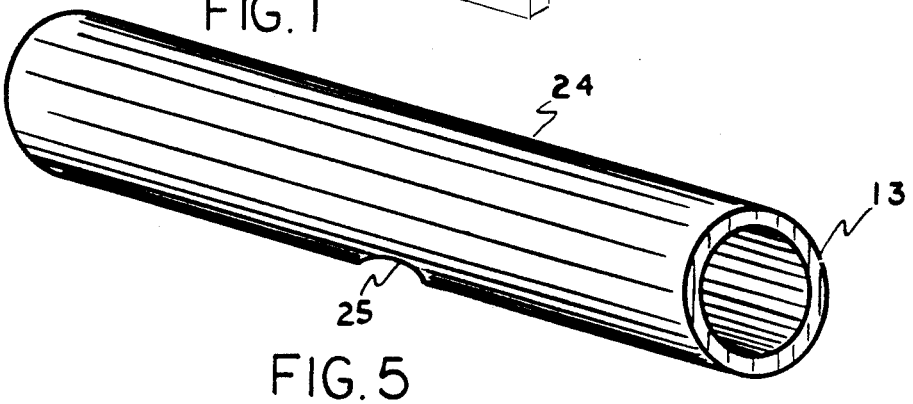
FIG. 5 is a perspective view of the scrubber material component of the embodiment of FIG. 1.

Scrubber material 13 is preferably a sleeve 24 as shown in FIGS. 4 and 5 and fabricated of a synthetic sponge adapted to slide onto head member 12. The embodiment of sleeve 24 exemplified in FIG. 5 is provided with an access aperture 25 to permit interengagement of handle post 11 with head member 12 after emplacement of said sleeve. In other embodiments of head member 12, different configurations of sleeve 24 may be employed.

Sleeve 24 is preferably fabricated of an elastomeric or equivalent material which permits the sleeve to be stretched to be emplaced upon the head member, and becomes secured in place by contractive force. A most suitable sleeve material is an open celled sponge fabricated of polyurethane. In alternative embodiments however, the scrubber material may instead be separate pieces which releasibly attach to flat faces 26, in which case at least those faces of the outer portions which are diagonally opposite with respect to said handle post contain scrubber material. In fact in said last-mentioned embodiment, the remaining diagonally opposed surfaces of the outer portions may hold squeegee blades 30 as shown in FIG. 6.

Regardless of the specific embodiment of scrubber material employed, it is desirable that the outer surface 28 of the scrubber material is substantially uniformly spaced from faces 26.

By virtue of the aforesaid arrangement of components, the device may be employed in a manner wherein the head member is inserted between two closely adjacent windows. The handle post is then twisted about its long axis. The twisting causes outer portions 19 to be deflected in a circular path orthogonal to the handle post, causing said outer portions to be displaced away from the handle post, namely away from the plane that contains said post and head member in T-configuration. Such displacement causes the scrubber material to abut against said windows. By employing a back-and-forth motion as shown by the double arrow in FIG. 1, all portions of the windows may be serviced. In the alternative embodiment of FIG. 6, when the handle post is twisted in one direction, the device functions as a scrubber, and when the handle post is twisted in the opposite direction, the device functions as a squeegee. In its flexed state, the head member has a Z-shape wherein the outer portions 19 are disposed at an angle of between about 95 and 160 degrees with respect to central portion 17.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A window cleaning device adapted to clean the facing glass window surfaces of the rear window of a pick-up truck and the front window of a closely adjacent camper shell, said device comprised of:

a) a rigid elongated straight handle, b) an elongated head member of monolithic construction having a rigid central portion orthogonally joined in T-configuration to said handle, said central portion terminating in flexing regions equidistantly spaced from opposite sides of said handle, and rigid outer portiions emergent from said flexing regions in linear alignment with said central portion in a manner permitting resilient movement of said outer portions in a path perpendicular to said handle, and c) resilient porous scrubber material attached to said outer portions, such that d) said device is held by said handle disposing said head member between said windows, and the handle is twisted about its axis, said outer portions pivot about said flexing regions and are pivoted in opposite directions away from the handle in parallel relationship to press said scrubber material against both said windows.

2. The device of claim 1 wherein said scrubber material is removably associated with said head member.

3. The device of claim 2 wherein said scrubber material is in the form of a sleeve which must be stretched to be emplaced upon said head member, and is secured in place by contractive force.

4. The device of claim 1 which additionally contains at least one resilient squeegee blade.

5. The device of claim 1 wherein said outer portions, when displaced away from said handle in parallel relationship, form with said central portion a Z-shaped configuration wherein the angle of said outer portions with respect to said central portion is between about 95 and 160 degrees.

6. The device of claim 4 wherein said handle, when twisted in one direction causes the head member to deploy said scrubber material, and when twisted in an opposite direction causes the head member to deploy said squeegee blade.

* * * * *